US006374636B1

(12) United States Patent
Thonnelier et al.

(10) Patent No.: US 6,374,636 B1
(45) Date of Patent: Apr. 23, 2002

(54) BATH REBOILER-CONDENSER AND CORRESPONDING AIR DISTILLATION PLANT

(75) Inventors: Jean-Yves Thonnelier, Voisins le; Jean-Yves Lehman, Maisons; Jean-Renard Brugerolle, Paris; Etienne Werlen, Versailles, all of (FR)

(73) Assignee: L'Air Liquide, Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 1 days.

(21) Appl. No.: 09/665,895

(22) Filed: Sep. 20, 2000

(30) Foreign Application Priority Data

Sep. 21, 1999 (FR) ..... 99 11777

(51) Int. Cl.[7] ..... F25S 3/04
(52) U.S. Cl. ..... 62/643
(58) Field of Search ..... 62/646, 643, 903; 165/110, 115

(56) References Cited

U.S. PATENT DOCUMENTS 3,992,168 A * 11/1976 Toyama et al. ..... 62/42
4,715,433 A * 12/1987 Schwarz et al. ..... 165/110
5,122,174 A * 6/1992 Sunder et al. ..... 62/24
5,755,279 A * 5/1998 Sweeney et al. ..... 165/115
5,775,129 A 7/1998 Satchell, Jr. et al.
5,868,199 A * 2/1999 Lavin ..... 165/166

* cited by examiner

*Primary Examiner*—William Doerrler
*Assistant Examiner*—Malik N. Drake
(74) *Attorney, Agent, or Firm*—Young & Thompson

(57) ABSTRACT

This bath reboiler-condenser (4), of the brazed plate type, includes vaporization passages (11) subdivided into a plurality of stacked vaporization regions (13A to 13C) each of which is immersed in a partial height bath (28A to 28C), and means for feeding the top vaporization region (13C) with liquid. The vaporization regions (13A to 13C) are spaced vertically and each region is entirely open at its top and bottom ends.

Application to the main reboiler-condensers of double air distillation columns.

18 Claims, 6 Drawing Sheets

BATH REBOILER-CONDENSER AND CORRESPONDING AIR DISTILLATION PLANT

The present invention relates to a bath reboiler-condenser, condenser, of the type comprising at least one exchanger body which comprises a stack of parallel plates, closure bars and spacer-waves which define a series of vaporization passages which are entirely open at their top and bottom ends, and a series of condensation passages.

The invention applies in particular to the main reboiler-condensers of air distillation plant which vaporize liquid oxygen at low pressure (typically a pressure slightly greater than atmospheric pressure) by condensing nitrogen at a medium pressure (typically an absolute pressure of 5 to 6 bars), and it will be explained hereinafter in that application.

Bath reboiler-condensers operate as a thermosiphon. The upward flow of the vaporizing oxygen is provided by the hydrostatic pressure due to the head of the liquid oxygen bath and to the reduction in weight of the vaporizing liquid.

For safety reasons, the recirculating liquid oxygen flow rate must be several times greater than the vaporized oxygen flow rate. For this reason, the head of the liquid oxygen bath must be approximately equal to the height of the exchanger, i.e. the exchanger is almost totally immersed in the liquid.

To reduce the temperature difference between the fluid which is condensing and the fluid which is vaporizing, in order to reduce the pressure of the heating nitrogen and therefore the energy required to compress the treated air, the heat-exchange area must be increased. Because the horizontal dimensions of the exchanger are limited by the space available in the bottom of the low-pressure distillation column, the height of the exchanger must be increased.

However, increasing its height increases the hydrostatic pressure of the liquid at the bottom of the column, i.e. at the inlet of the vaporization passages. This creates in the lower part of the exchanger a region containing undercooled free liquid and at least partially neutralizes the beneficial effect of increasing the heat exchange area.

The object of the invention is to improve the efficiency of the reboiler-condenser with a relatively simplified construction.

To this end, the invention provides a reboiler-condenser of the aforementioned type characterized in that the vaporization passages are subdivided by separator bars into at least two stacked vaporization regions each of which is entirely open at its bottom end and at its top end, each vaporization region being provided with a liquid recirculation corridor and overflow means at the top whereby the liquid overflows into an underlying vaporization region to create in each vaporization region a partial-height bath separated from the other bath(s) and in which said region is immersed to substantially all of its height, in that the top end of each bottom vaporization region and intermediate vaporization region is spaced vertically from the separator bar which supports the next higher bath, and in that the heat-exchanger body includes means for supplying liquid to the top vaporization region and means for evacuating vapor at each intermediate level between two vaporization regions.

The invention also provides air distillation plant including a main reboiler-condenser as defined hereinabove for vaporizing liquid oxygen by condensing nitrogen.

Embodiments of the invention will now be described with reference to the accompanying drawings, in which.

Figure 2:
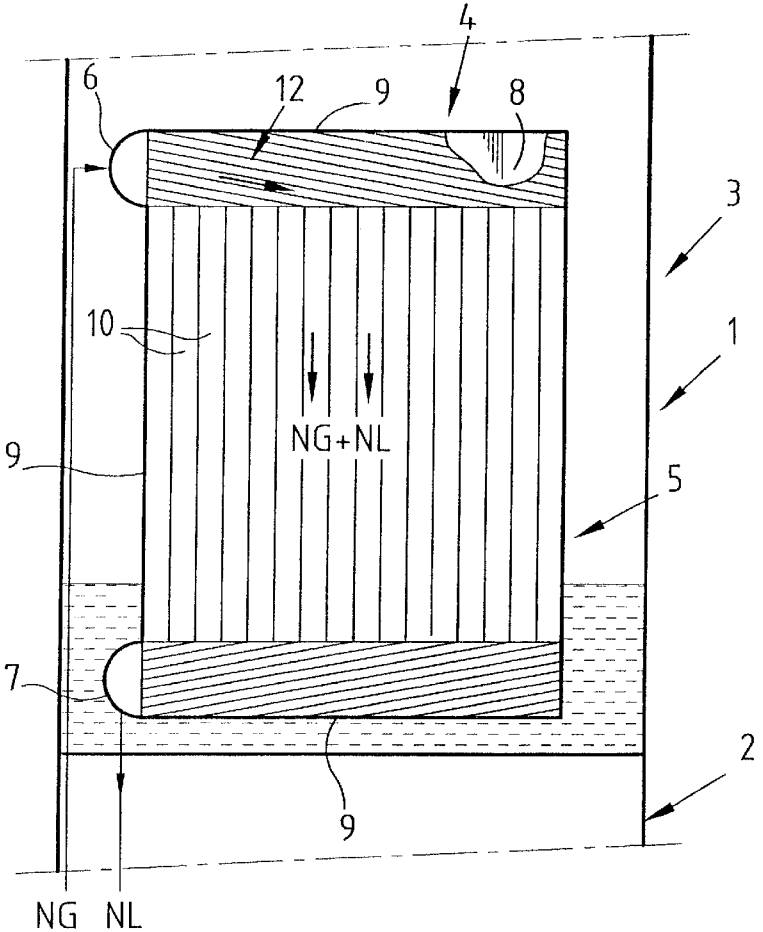
FIG. 2 is an analogous view of the distillation plant shown in vertical section in a condensation passage of the main reboiler-condenser.
Figure 1:
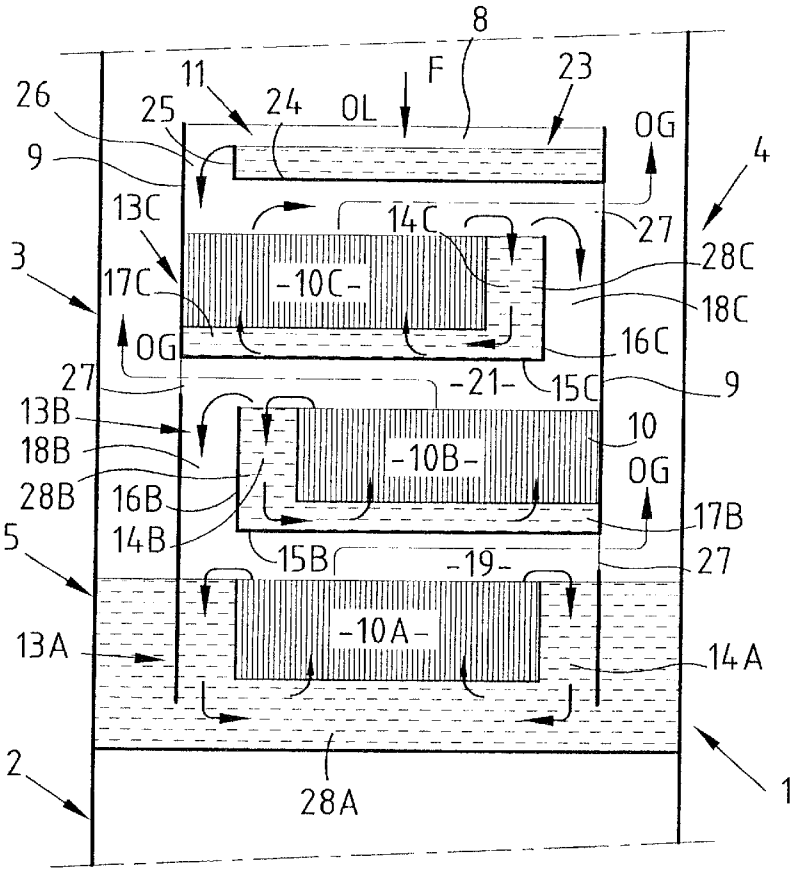
FIG. 1 is a diagrammatic representation of part of air distillation plant according to the invention, which is shown in vertical section in a vaporization passage of the main reboiler-condenser.

The air distillation plant 1 of which a portion is shown in FIGS. 1 and 2 is a double distillation column consisting of a medium-pressure distillation column 2 on top of which is a low-pressure distillation column 3. The nitrogen in the top of the column 2, which operates at an absolute pressure of 5 to 6 bars, exchanges heat in the main reboiler-condenser 4 of the plant with liquid oxygen produced at the bottom of the column 3. The column 3 operates at a pressure slightly greater than atmospheric pressure. To be more precise, the reboiler-condenser 4 vaporizes the liquid oxygen in the bottom of the low-pressure column by condensing gaseous nitrogen from the top of the medium-pressure column.

The reboiler-condenser 4 is fixed into the bottom of the shell of the low-pressure column 3 with a free space between it and the shell all around it. It comprises a single heat exchanger body 5 of the type with brazed plates and two semi-cylindrical boxes 6 and 7 welded to the body. The generally parallelepiped-shaped heat-exchanger body 5 comprises a stack of identical vertical rectangular aluminum plates 8, closure bars 9 shown only as thick lines, separator bars described below, and spacer-waves 10 made of perforated corrugated sheet metal, for example. The assembly is brazed in a single operation in a furnace. The two boxes 6 and 7 are welded to the body 5 and comprise a top lateral box 6 for entry of gaseous nitrogen and a bottom lateral box 7 for exit of liquid nitrogen. Of course, the box 7 has an outlet for "non-condensables" (not shown).

Each pair of adjacent plates 8 delimits a generally flat passage. The passages are alternately oxygen vaporization passages 11 (FIG. 1) and nitrogen condensation passages 12 (FIG. 2). The bars 9 close the perimeter of the passages except for fluid inlet/outlet openings.

Thus the passages 11 are closed laterally over most of their height and totally open at their top and bottom ends.

On the other hand, the passages 12 are closed throughout their periphery except for a top lateral inlet for gaseous nitrogen which communicates with the box 6 and a bottom lateral outlet for liquid nitrogen which communicates with the box 7.

Each vaporization passage 8 (FIG. 1) is subdivided into a plurality of stacked vaporization regions, of which there are three in this example, namely a bottom vaporization region 13A, an intermediate vaporization region 13B and a top vaporization region 13C. Each region 13A to 13C is substantially totally immersed in a bath of liquid oxygen and is defined by a respective rectangular wave 10A to 10C with vertical generatrices.

The wave 10A of the bottom region 13A extends across most of the horizontal width of the passage. On respective opposite sides of the wave, a liquid recirculation duct 14A is delimited between the wave and the adjacent closure bar 9.

The intermediate region 13B is above and at a vertical distance from a horizontal bottom separator bar 15B, which extends from one bar 9 (that on the right in FIG. 1) to a point spaced from the opposite bar 9. The region 13B runs from the right-hand bar 9 to a point at a distance from a vertical retaining bar 16B, which starts from the left-hand end of the bar 15B. The wave 10B is disposed in the space defined by the bars 15B and 16B. The top edge of the wave is substantially level with the top end of the bar 16B and its bottom edge and the top bar 15B delimit a source supply free space 17B. In the horizontal direction, the wave 10B starts from the right-hand bar 9 and terminates at point at a small distance from the bar 16B, with which it delimits a liquid recirculation space 14B.

The bar 15B is spaced vertically from the top edge of the wave 10A. This defines between the regions 13A and 13B a free space 19 which extends the full width of the heat exchanger body and which is connected to a liquid descent free space 18B between the left-hand bar 9 and the bar 16B.

The top vaporization region 13C has the same structure as the region 13B, but reversed left-to-right, with a bottom separator bar 13C, a lateral retaining bar 16C and a supply free space 17C and a recirculation free space 14C delimited by the wave 10C. The bar 15C is spaced vertically from the top edge of the wave 10B, which defines between the regions 13B and 13C a free space 21 which extends the full width of the heat exchanger body. The space 21 is connected to a descent free space 18C delimited between the bar 16C and the right-hand bar 9.

A supply weir 23 consisting of a horizontal bottom bar 24 and a short vertical lateral bar 25 is located above in the upper end region of the vaporization passage and at a distance from the region 13C. The bar 24 starts from the right-hand bar 9 and the bar 25 is connected to the left-hand end of the bar 24 and is substantially vertically aligned with the bar 16B. This defines a supply descent 26 between the bar 25 and the left-hand bar 9.

The right-hand closure bar 9 defines a window 27 between the regions 13A and 13B and between the region 13C and the weir 23. The left-hand closure bar 9 defines an analogous window 27 between the regions 13B and 13C.

The waves 10 of the condensation passages 12 have vertical generatrices over most of the height of the passages and are extended upward and downward by oblique distribution waves which communicate with the lateral nitrogen inlet/outlet windows, in the conventional way.

In operation, a constant level mass of liquid oxygen is accumulated in the bottom of the column 3. Its free surface is substantially level with the top edge of the wave 10A, with the result that the wave is substantially totally immersed in a bottom partial-height bath 28A of liquid oxygen.

The liquid oxygen produced by the column 3 is distributed substantially uniformly into the set of weirs 23, as shown diagrammatically by the arrow F in FIG. 1.

The liquid overflows and drops into the region 13C, where it forms a top partial-height bath 28C. The liquid oxygen is partly vaporized in this region. The excess liquid overflows over the bar 16C into the space 18C and drops into the region 13B. The vaporized oxygen escapes from the heat-exchanger body in the column 3, mostly via the top window 27.

Similarly, in the region 13B, the liquid oxygen forms an internal partial-height bath 28B. Partial vaporization of the oxygen in the region 13B forms gaseous oxygen which escapes from the heat exchanger body into the column 3 via the intermediate window 27. The excess liquid overflows over the bar 16B and drops into the bottom bath 28A via the descent 18B.

Partial vaporization of the oxygen in the bottom bath forms gaseous oxygen which escapes into the column 3 via the bottom window 27. The excess liquid overflows and recirculates of its own accord into the bath 22A via the descents 14A.

Partial vaporization of the oxygen in each bath causes a flow of liquid by the thermosiphon effect, with recirculation via the spaces 14A, 14B and 14C.

In the conventional way, gaseous nitrogen from the top of the column 2 enters the condensation passages 12 (FIG. 2) via the top box 6 and then descends in the heat-exchanger body, progressively condensing as it travels its full height. The liquid nitrogen collects at the base and returns to the column 2 via the bottom box 7.

In the FIG. 1 example, only the bottom vaporization regions 13A of the various vaporization passages communicate with each other via the bottom bath 28A. The other vaporization regions are isolated from their counterparts in the other passages. This calls for a distributor to distribute the liquid uniformly between the passages at the top of the reboiler-condenser, using appropriate means known in the art and not shown.

Figure 3:
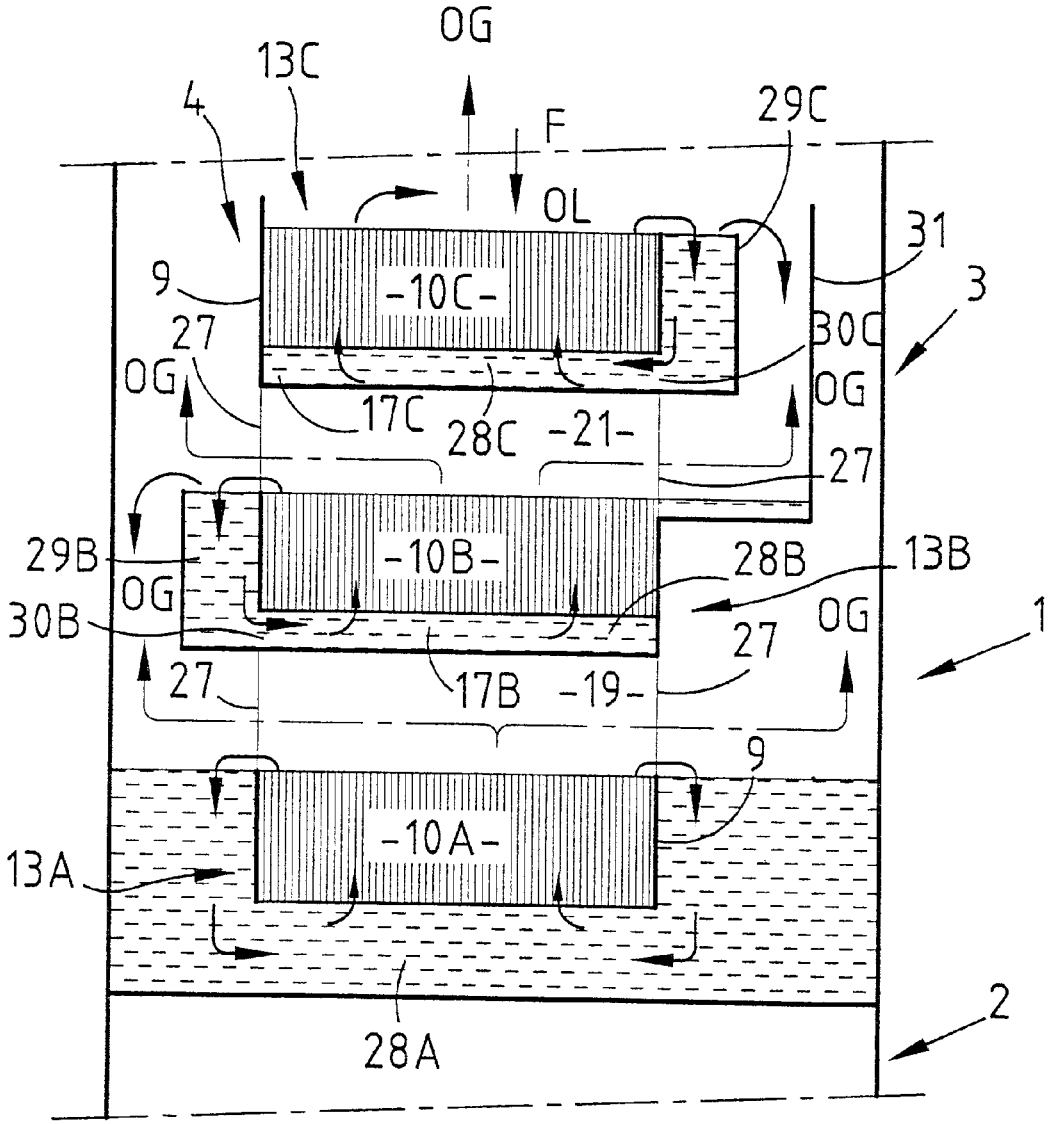
FIG. 3 is a view analogous to that of FIG. 1 of a variant.

In the FIG. 3 example, on the other hand, means are provided for communication between all of the regions 13B, on the one hand, and all of the regions 13C, on the other hand. To this end, the reboiler-condenser is modified as follows:

- the weir 23 is eliminated;
- the bars 16B and 16C are eliminated and the waves 10A to 10C extend the full height of the passages 11;
- the top window 27 in FIG. 1 is eliminated and windows 27 are provided on the right and on the left in the closure bars 9 between the regions 13A and 13B and between the regions 13B and 13C;
- the following are added throughout the thickness of the heat exchanger body, i.e. perpendicularly to the plane of the drawing:
  - on the right of the body 5, a top trough 29C which collects all of the liquid which overflows from the region 13C and whose bottom part communicates with the space 17C via an additional window 30C in the right-hand bar 9;
  - an intermediate trough 31 which caps the previous trough and collects all of the liquid that overflows from it; the bottom part of the trough 31 communicates with the right-hand window 27 between the windows 13B and 13C; and
  - on the left of the body 5, a bottom trough 29B which collects all of the liquid which overflows from the region 13B and whose bottom part communicates with the space 17B via an additional window 30B in the left-hand bar 9.

Accordingly, in operation, the liquid oxygen can drop directly onto the heat exchanger body, as shown diagrammatically by the arrow F in FIG. 3. It forms the top bath 28C on being divided between all of the regions 13C via the trough 29C. From there, the liquid overflows into the trough 31 to feed the intermediate bath 28B and is distributed between all of the regions 13B via the trough 29B. From there, the liquid overflows into the bottom bath 28A.

The gaseous oxygen produced by vaporization enters the column 3 via the two bottom windows 27, via the two top windows 27 and via the top opening of the passages 11, across their full width.

Figure 4:
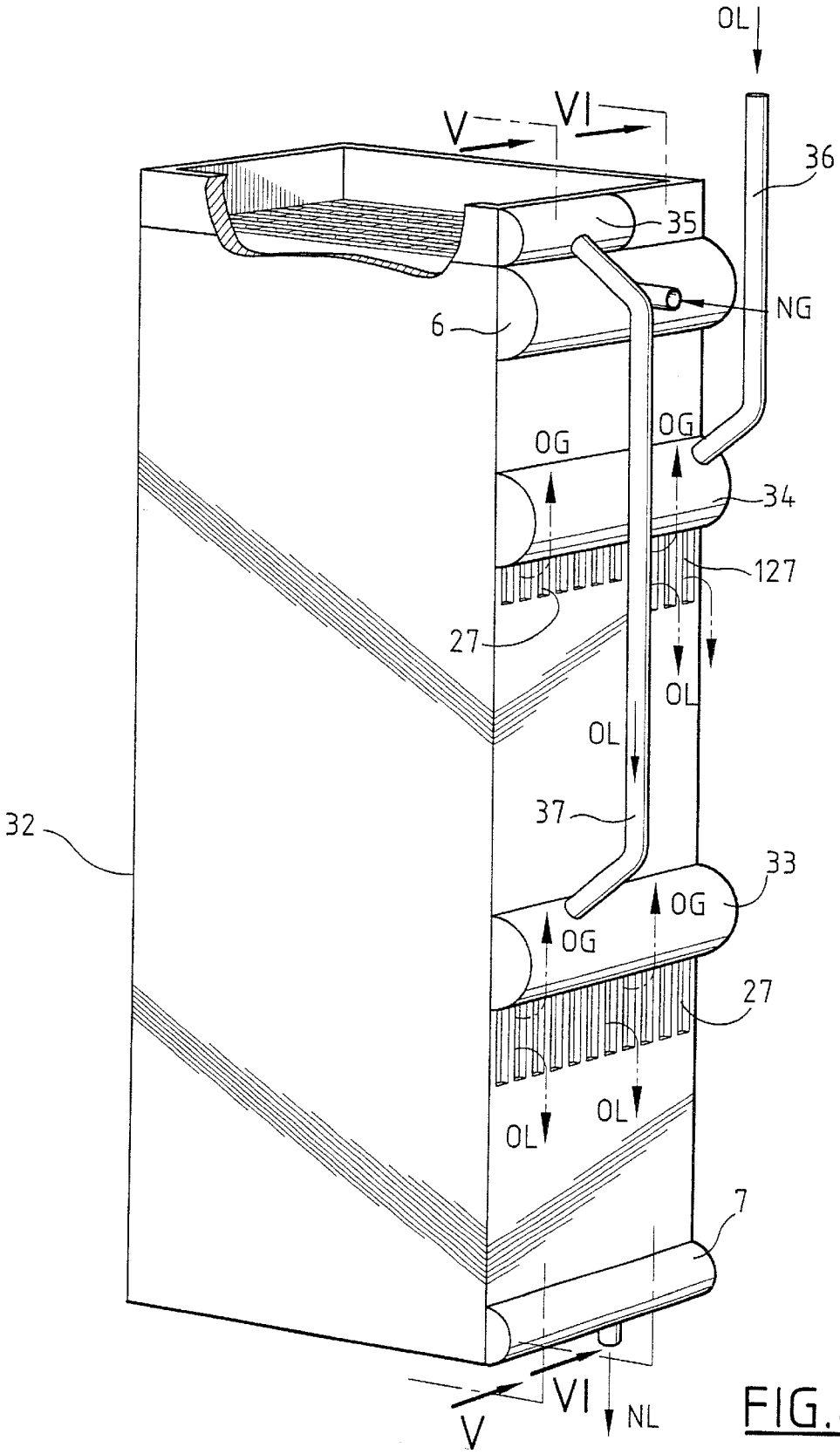
FIG. 4 is a perspective view of another variant.
Figure 6:
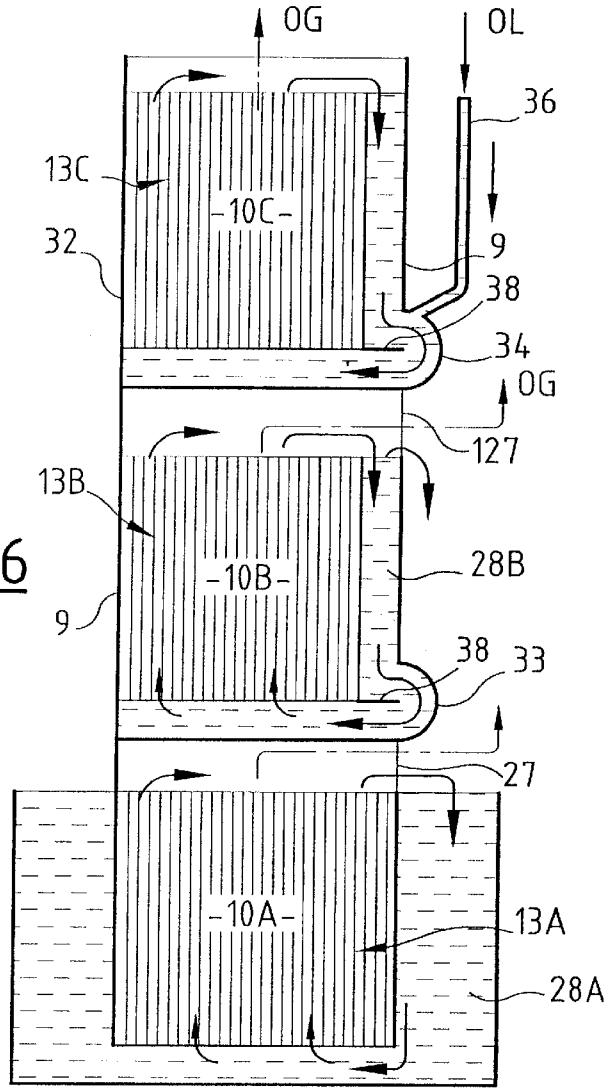
FIGS. 5 and 6 are views analogous to that of FIG. 1 and respectively in section taken along the lines V—V and VI—VI in FIG. 4.
Figure 5:
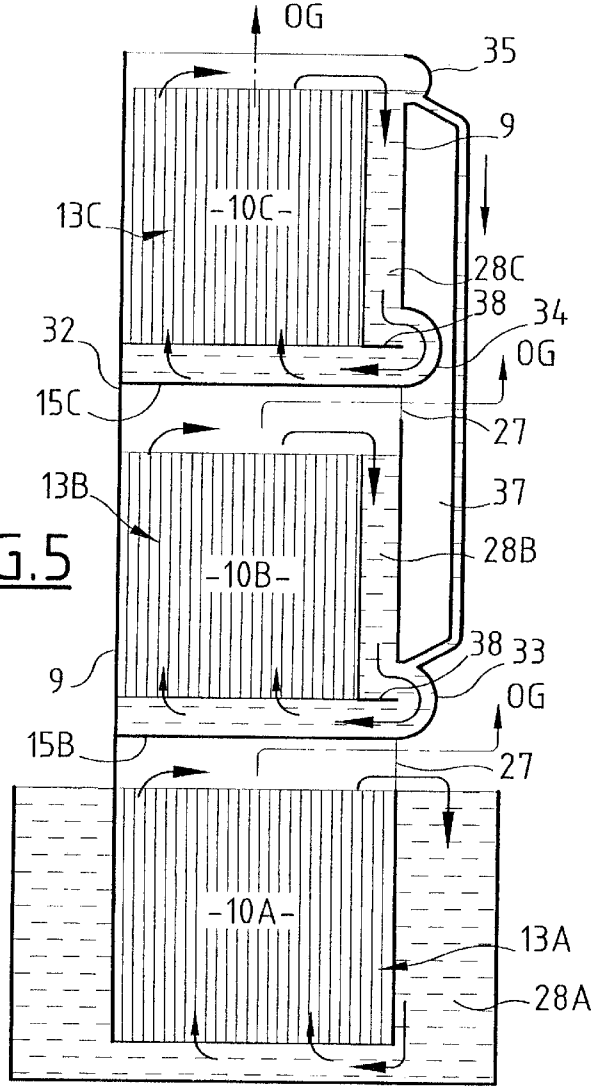

In the embodiment shown in FIGS. 4 to 6, the lateral face 32 of the reboiler-condenser, consisting of edges of plates and closure bars 9, has no openings or accessories. This enables two identical reboiler-condensers to be placed together back-to-back.

The following are provided on the opposite lateral face, from the bottom upwards:

the liquid nitrogen outlet box 7;

a horizontal row of identical windows 27 through which liquid oxygen overflows and vaporized gaseous oxygen is evacuated from the bottom region 13A;

a semi-cylindrical box 33 extending the full thickness of the reboiler-condenser for feeding all the intermediate regions 13B and for mixing liquid;

a row of windows consisting, in the left-hand part (as seen in FIG. 4) of the thickness of the reboiler-condenser, windows 27 for evacuating gaseous oxygen vaporized in the region 13B and, in the right-hand part of said thickness, windows 127 for evacuating gaseous oxygen and overflow of liquid oxygen; the windows 27 and 127 have their top edges at the same level but the windows 127 are higher;

a semi-cylindrical box 34 for feeding liquid to all the top regions 13C; this box extends the full thickness of the reboiler-condenser;

the gaseous nitrogen inlet box 6; and a semi-cylindrical box 35 for overflow of liquid from all the top regions 13C; this box extends over only the left-hand part of the thickness of the reboiler-condenser.

A liquid supply pipe 36 of the reboiler-condenser terminates in the box 34, near its right-hand end, and a liquid supply pipe 37 of the region 13B connects the box 35 to the box 33, near its left-hand end.

As can be seen in FIGS. 5 and 6, the region 13A extends the full width of each vaporization passage 11 and each region 13B, 13C starts from the left-hand bar 9 (FIGS. 5 and 6) and leaves a recirculation space 14B, 14C between it and the right-hand bar 9. The windows 27 and 127 are just below the separator bars 15B and 15C. The bottom windows 27 extend downward as far as the top of the region 13A and the windows 127 extend downward as far as the top of the region 13B.

The bottom generatrix of the box 33 is at the same level as the bar 15B, that of the box 34 at the same level as the bar 15C (FIG. 6), and that of the box 35 is substantially level with the top of the region 13C. As in FIG. 3, the latter is totally open at the top, like the regions 13A and 13B.

A section of horizontal bar 38, forming a chicane, is provided halfway up the height of each box 33 and 34 and at the level of the lower edge of the corresponding wave 10B, 10C.

In operation, the top regions 13C are source fed via the pipe 36 and the box 34. The level is equalized in all the regions 13C and the recirculating liquid is mixed with fresh liquid at the top of that region and via the box 34.

The liquid that overflows from the regions 13C passes via the box 35 and the pipe 37 into the box 33 where it is mixed with the liquid recirculating in each region 13B.

The liquid which overflows from the regions 13B passes through the bottom part of the windows 127 and drops directly into the bottom bath 28A (FIG. 6).

Note that, in the regions 13B and 13C, the supply of liquid and the overflow occur at opposite points relative to the direction of the thickness of the reboiler-condenser. This encourages mixing of the recirculating liquid with the fresh liquid, so reducing the risk of local concentration of pollutants. Mixing is further encouraged by the bars 38.

Figure 7:
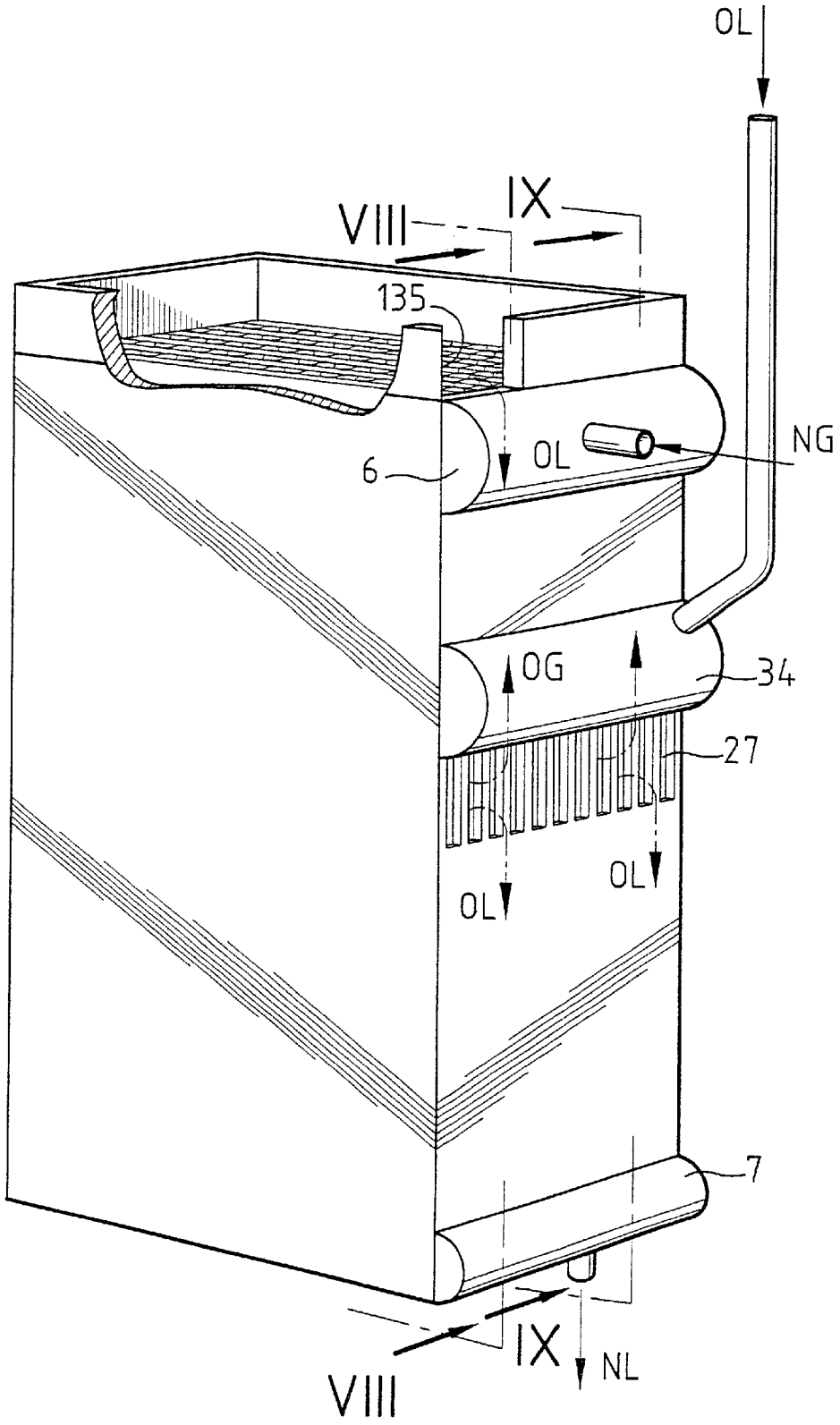
FIG. 7 is a view analogous to that of FIG. 4 of a further variant.
Figure 9:
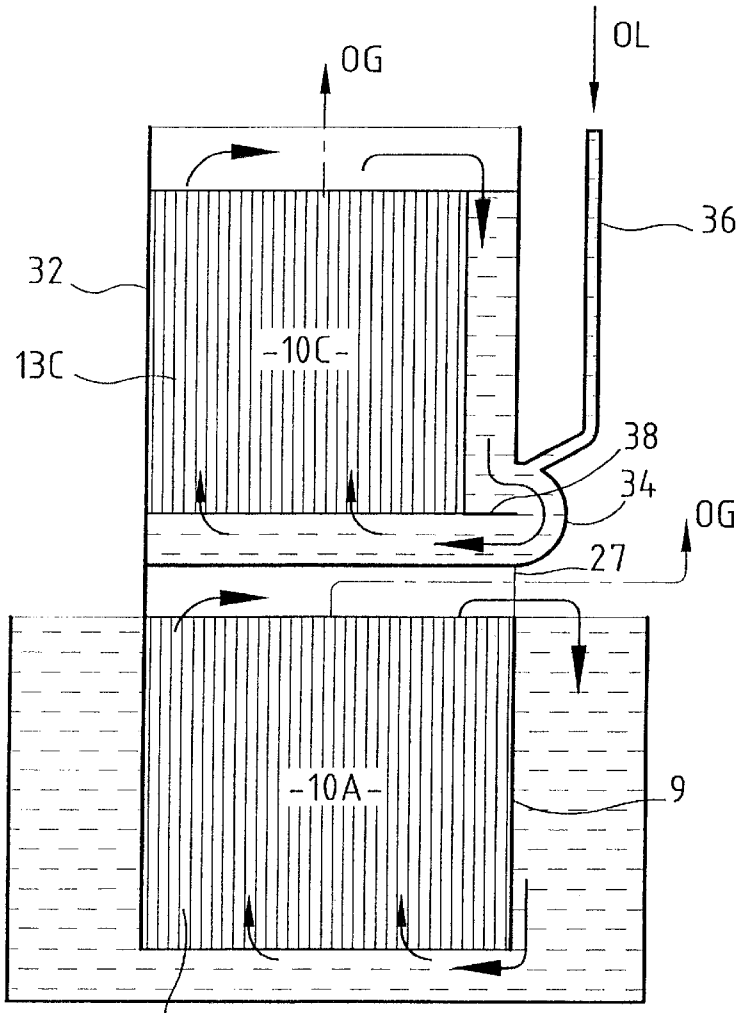
FIGS. 8 and 9 are views analogous to that of FIG. 1 and respectively in section taken along the lines VIII—VIII and IX—IX in FIG. 7.
Figure 8:
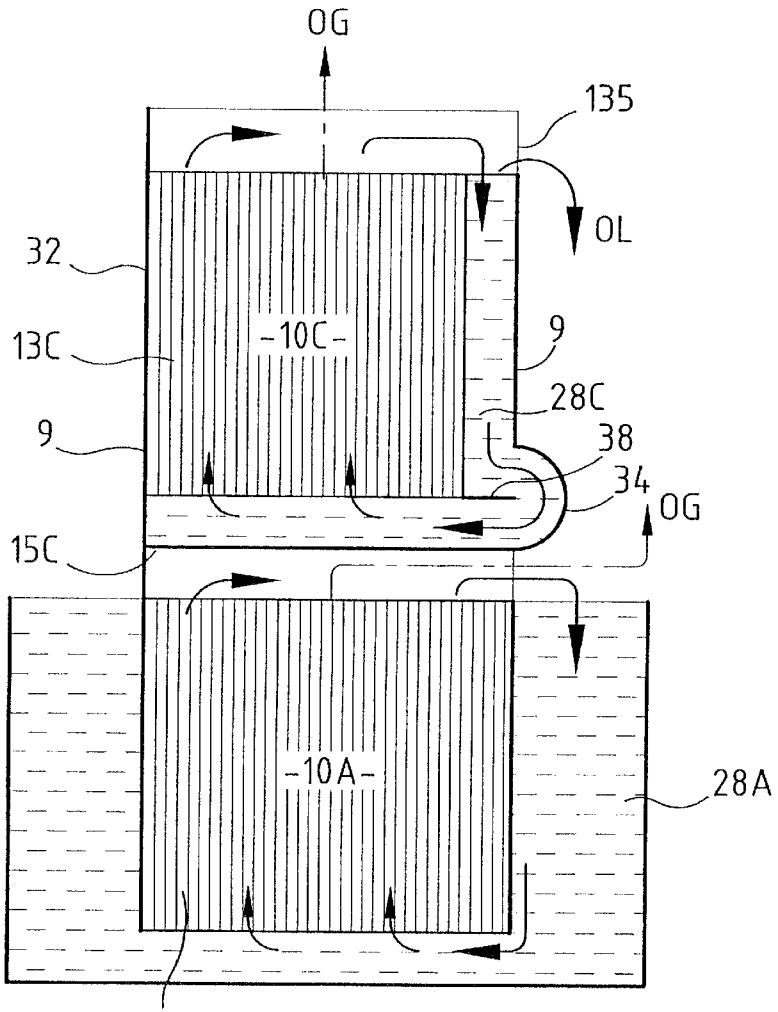

The variant shown in FIGS. 7 to 9 corresponds essentially to the previous embodiment with the intermediate stage 13B eliminated. In a simplified embodiment of this kind, the pipe 37 and the box 35 are replaced by a simple notch 135 formed in the left-hand part of the top liquid retaining wall, and it is no longer necessary to provide two types of windows: the windows 27, which are necessary only for the bottom stage, are all the same height and are used both for overflow of liquid oxygen and evacuation of gaseous oxygen.

What is claimed is:

1. A bath reboiler-condenser, of the type comprising at least one heat-exchanger body (5) which comprises a stack of parallel plates (8), closure bars (9) and spacer-waves (10) which define a series of vaporization passages (11) entirely open at the bottom end and at the top end and a series of condensation passages (12), characterized in that the vaporization passages are subdivided by separator bars (15, 16) into at least two stacked vaporization regions (13A to 13C) each of which is entirely open at its bottom end and at its top end, each vaporization region being provided with a liquid recirculation corridor (14A to 14C) and overflow means (16B, 16C; 29B, 29C; 27, 35, 127) at the top whereby the liquid overflows into an underlying vaporization region (27) to create in each vaporization region a partial-height bath (28A to 28C) separated from the other bath(s) and in which said region is immersed to substantially all of its height, in that the top end of each bottom vaporization region (13A) and intermediate vaporization region (13B) is spaced vertically from the separator bar (15B, 15C) which supports the next higher bath, and in that the heat-exchanger body (5) includes means for supplying liquid to the top vaporization region (13C) and means (27; 27, 127) for evacuating vapor at each intermediate level between two vaporization regions (13A–13B, 13B–13C).

2. A reboiler-condenser according to claim 1, characterized in that said vapor evacuation means include vapor evacuation openings (27; 27, 127) defined by the lateral closure bars (9) at each intermediate level between two vaporization regions (13A–13B, 13B–13C).

3. A reboiler-condenser according to claim 1, characterized in that the bottom separator bar (15B, 15C) of each vaporization region is connected at one end to a lateral closure bar (9) of the vaporization passage (11) and in that the overflow means are on the opposite side of that passage.

4. A reboiler-condenser according to claim 1, characterized in that the recirculation corridor (14A to 14C) is inside the vaporization passage (1), in particular between the vaporization region (13A to 13C) and a lateral closure bar (9) of said passage.

5. A reboiler-condenser according to claim 1, characterized in that each bottom separator bar (15B, 15C) extends over only a part of the width of the vaporization passage (11) and in that the overflow means of at least one vaporization region (13B, 13C) are formed by a retaining bar (16B, 16C) inside the vaporization passage which forms a weir.

6. A reboiler-condenser according to claim 1, characterized in that the intermediate vaporization regions (13B) or top vaporization regions (13C) of each vaporization passage (11) do not communicate with those of the other vaporization passages and in that said liquid supply means are adapted to divide the liquid substantially uniformly between the vaporization passages (11).

7. A reboiler-condenser according to claim 1, characterized in that at least one intermediate region (13B) or top region (13C) communicates with a counterpart region of all the other vaporization passages via a lateral channel (29B, 29C; 33) which extends across the thickness of the reboiler-condenser (1).

8. A reboiler-condenser according to claim 7, characterized in that said lateral channel (29B, 29C) forms a liquid recirculation trough.

9. A reboiler-condenser according to claim 7, characterized in that said lateral channel (29B, 29C) forms the overflow means.

10. A reboiler-condenser according to claim 1, characterized in that the overflow means include a duct (37) laterally of the heat exchanger body (5) which connects a top point of one vaporization region (13C) to a bottom point of the underlying vaporization region (13B).

11. A reboiler-condenser according to claim 1, characterized in that, for at least one vaporization region (13B, 13C), the overflow means (35, 127) start from a location which is opposite a bottom liquid supply point of that region relative to the direction of the thickness of the heat exchanger body (5).

12. A reboiler-condenser according to claim 1, characterized in that, for at least one vaporization region (13B, 13C), the overflow means (16B, 16C; 29B) are on the opposite side of that region relative to the direction of the width of the passage to the location (18C, 26; 31) where that region is supplied with liquid.

13. A reboiler-condenser according to claim 1, characterized in that, at the top end of at least one vaporization region (13A, 13B), the lateral bars (9) of the vaporization passages (11) define a row of vaporized fluid evacuation windows (27, 127), at least some of which also form said overflow means.

14. A reboiler-condenser according to claim 13, characterized in that said part (127) of the row of windows is higher than the other windows of that row.

15. A reboiler-condenser according to claim 1, including at least three vaporization regions (13A to 13C), characterized in that the overflow means (16B, 16C; 29B, 29C) are alternately on one side and the other side of the vaporization passage (11).

16. A reboiler-condenser according to claim 1, characterized in that the overflow means (27, 35, 127) are all on the same side of the vaporization passages (11) and the opposite lateral face (32) of the heat exchanger body (5) is plane.

17. A reboiler-condenser according to claim 16, characterized in that it includes two heat-exchanger bodies (5) in contact at their plane lateral faces (32).

18. Air distillation plant including a reboiler-condenser for vaporizing liquid oxygen by condensing nitrogen, characterized in that the reboiler-condenser includes at least one heat-exchanger body (5) which comprises a stack of parallel plates (8), closure bars (9) and spacer-waves (10) which define a series of vaporization passages (11) entirely open at the bottom end and at the top end and a series of condensation passages (12), characterized in that the vaporization passages are subdivided by separator bars (15, 16) into at least two stacked vaporization regions (13A to 13C) each of which is entirely open at its bottom end and at its top end, each vaporization region being provided with a liquid recirculation corridor (14A to 14C) and overflow means (16B, 16C; 29B, 29C; 27, 35, 127) at the top whereby the liquid overflows into an underlying vaporization region (27) to create in each vaporization region a partial-height bath (28A to 28C) separated from the other bath(s) and in which said region is immersed to substantially all of its height, in that the top end of each bottom vaporization region (13A) and intermediate vaporization region (13B) is spaced vertically from the separator bar (15B, 15C) which supports the next higher bath, and in that the heat-exchanger body (5) includes means for supplying liquid to the top vaporization region (13C) and means (27; 27, 127) for evacuating vapor at each intermediate level between two vaporization regions (13A–13B, 13B–13C).

* * * * *